US005812910A

United States Patent [19]

Kim

[11] Patent Number: 5,812,910

[45] Date of Patent: Sep. 22, 1998

[54] DEVELOPING UNIT FOR ELECTROPHOTOGRAPHIC PROCESSORS WITH OPENABLE TOP COVERS

[75] Inventor: Jong-Hak Kim, Suwon, Rep. of Korea

[73] Assignee: SamSung Electronics Co., Ltd., Suwon, Rep. of Korea

[21] Appl. No.: 787,670

[22] Filed: Jan. 24, 1997

[30] Foreign Application Priority Data

Jan. 25, 1996 [KR] Rep. of Korea ..... 1597/1996

[51] Int. Cl.[6] ..... G03G 21/16

[52] U.S. Cl. ..... 399/111; 399/119; 16/112

[58] Field of Search ..... 399/108, 110, 399/111, 119, 262; 16/112, 115

[56] References Cited

U.S. PATENT DOCUMENTS

| | | | |
|---|---|---|---|
| D. 336,245 | 6/1993 | Savas . | |
| 3,447,193 | 6/1969 | Bush . | |
| 3,447,194 | 6/1969 | Bush . | |
| 3,447,195 | 6/1969 | Bush . | |
| 4,017,005 | 4/1977 | Forbes, Jr. . | |
| 4,148,431 | 4/1979 | Lepisto . | |
| 4,583,832 | 4/1986 | Kasamura et al. . | |
| 4,741,073 | 5/1988 | Capen . | |
| 4,839,691 | 6/1989 | Tagawa et al. . | |
| 5,426,885 | 6/1995 | Wittman . | |
| 5,491,539 | 2/1996 | Shoji et al. | 399/111 |

FOREIGN PATENT DOCUMENTS

| | | |
|---|---|---|
| 812919 | 5/1937 | France . |
| 60-179 753 A | 9/1985 | Japan . |
| 60-179753 | 9/1985 | Japan . |
| 1-293 369 A | 11/1989 | Japan . |
| 3-226 764 A | 10/1991 | Japan . |

OTHER PUBLICATIONS

*Patents Abstract Japan,* P–426, 1986, vol. 10, No. 30.

*Patents Abstract of Japan,* P–1295,, 1992 vol. 16, No. 5.

*Patents Abstract of Japan,* P–1006, 1990,vol. 14, No. 78.

*Primary Examiner*—Joan H. Pendegrass

*Attorney, Agent, or Firm*—Robert E. Bushnell, Esq.

[57] ABSTRACT

An easy to install and remove developing unit for an electrophotographic machine is disclosed. The developing unit contains a spring loaded handle that works in cooperation with the top cover or lid of the electrophotographic device. When the lid is opened, the spring loaded handle pops up, allowing the user to grab the handle and pull the developing unit out of the electrophotographic machine. When the lid is closed onto the handle, the cover works against the spring bias and compresses the handle into a small, compact space that fits within the electrophotographic machine. The result is a compact and efficient developing unit that allows the user to easily remove and install the developing unit into and out of the electrophotographic device.

15 Claims, 2 Drawing Sheets

DEVELOPING UNIT FOR ELECTROPHOTOGRAPHIC PROCESSORS WITH OPENABLE TOP COVERS

This application makes claims all benefits accruing under 35 U.S.C. 517 119 from an application for DEVELOPING UNIT FOR ELECTROPHOTOGRAPHIC PROCESSORS WITH OPENABLE TOP COVERS earlier filed in the Korean Industrial Property Office on 25 Jan. 1996 and there duly assigned Ser. No. 1597/1996.

BACKGROUND OF THE INVENTION

1. Field of the Invention

The present invention relates, in general, to a developing unit for electrophotographic processors with openable top covers and, more particularly, to a structural improvement in the developing unit of such an electrophotographic processor, for example, a laser beam printer, in order to allow a user to easily handle the unit while removing the unit from the processor's housing.

2. Description of the Related Art

As well known to those skilled in the art, the developing unit in an electrophotographic processor with an openable top cover forms a picture on a photosensitive drum, so that the unit performs a very important operational function during a picture forming operation of the electrophotographic processor. The above developing unit is installed in a processor's housing at a position in vicinity to the top of the housing.

It is already disclosed in the art the notion of placing a handle on top of the developing unit to allow the user to easily remove the developing unit from the electrophotographic machine. For example, U.S. Pat. No. 4,583,832 for a Developing Device to Kasamura et al. discloses a developing device containing a handle that can be drawn out or compressed. The handle can be extended outwards so that it can enable a user to remove the developing device from the electrophotographic machine. When the handle is not in use, the handle can be compressed. The handle does not appear to be spring biased to either an open or a closed position.

U.S. Pat. No. 4,839,691 for an Image Forming Apparatus to Tagawa et al. discloses an image forming apparatus that can be removed by lifting up a handle on a dispenser. When not in use, the handle is folded over. When in use, the handle is rotated upwards, allowing the user to remove the developing device from the electrophotographic machine without requiring the user to stick his/her hands inside electrophotographic machine.

U.S. Pat. No. 4,017,005 for a Corrugated Discharge Control Device For A Dispenser to Forbes Jr. discloses a dispenser that contains a collapsible handle on the top. The dispenser may be held and removed by the handle. As a result, the user does not have to stick his/her hands inside the machine to remove the dispenser as the handle is used instead.

What is needed is a handle that automatically pops up when the cover to the developing unit is opened. What is also needed is a handle that automatically compresses whenever the cover to the developing unit is closed, further facilitating the ease to which the user can remove or install a developing unit in an electrophotographic device.

SUMMARY OF THE INVENTION

It is, therefore, an object of the present invention to provide a developing unit for electrophotographic processors with openable top covers in which a torsion spring-biased handle that is mounted to the top of a developing unit is elastically raised from its closed position when the top cover is opened, thereby being convenient to users by allowing users to easily remove the unit from the processor's housing.

The present invention provides an electrophotographic processor with an openable top cover, having a developing unit detachably installed in a processor's housing at a position in vicinity to the top of the housing, the unit being selectively removed from the housing with the top cover being opened; a handle being biased upward by the elastic spring, so that the handle is popped up in an open position by the elastic spring when the cover is opened but is pushed down to a closed position when the cover is closed onto the handle mounted on the developing unit.

In another aspect, the present invention provides a developing unit for electrophotographic processors with openable top covers, having a depression formed on the top of the developing unit at a position corresponding to an openable top cover of an electrophotographic processor; a handle mounted to the top of the developing unit, the handle having a longitudinal slot; and an elastic spring coupled to both the depression of the unit and the longitudinal slot of the handle thereby coupling the handle to the top of the developing unit, the elastic spring biasing the handle upward so as to normally retain the handle in a closed position when the handle is pushed down by the closed cover, but to elastically raise the handle from the closed position to an open position when the top cover is opened.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
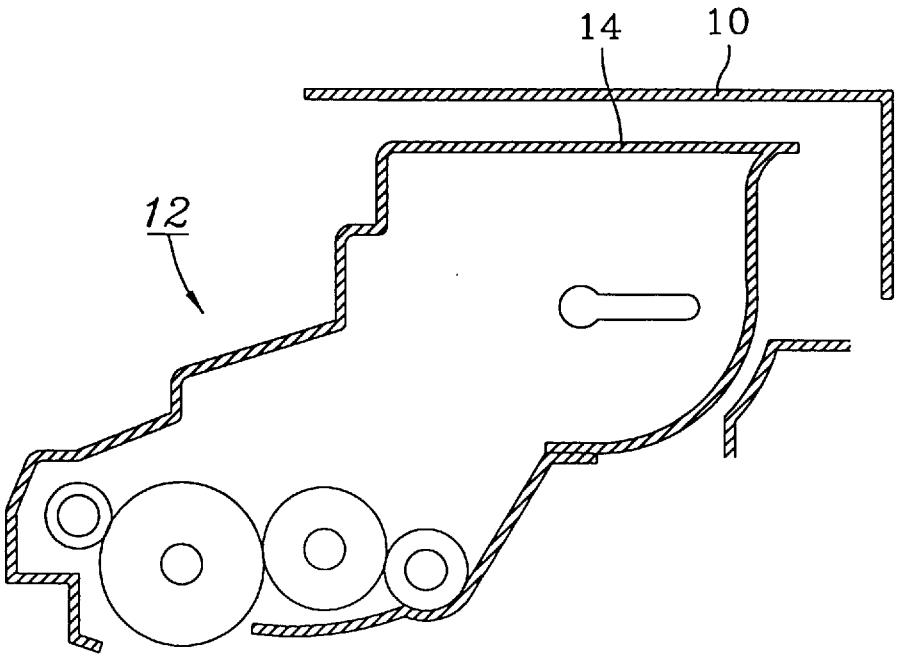
FIG. 1 is a sectional view showing a typical developing unit installed in an electrophotographic processor with an openable top cover.
Figure 2:
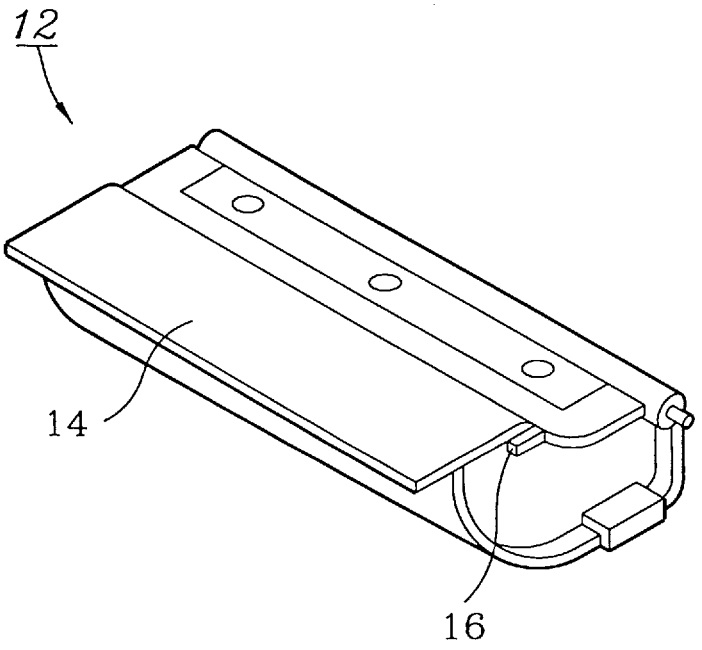
FIG. 2 is a perspective view showing the configuration and construction of the typical developing unit.

FIGS. 1 and 2 show the location, configuration and construction of a typical developing unit for electrophotographic processors with openable top covers. As shown in FIGS. 1 and 2, when it is necessary to repair the developing unit or to exchange the existing developing unit with a new one during the operation of the processor, the top cover 10 which is hinged to the top of a processor's housing must be opened. In order to open the top cover 10, a user lifts up the cover 10 while pushing a top cover release button (not shown) that is provided on the top of the processor.

When the top cover 10 is opened as described above, the developing unit 12 is exposed outside the processor's housing. The above unit 12 is detachably mounted to a bracket inside the housing and has two handle protrusions 16, so that the unit 12 can be manually removed from the housing. In order to remove the unit 12 from the processor's housing, the user separates the unit 12 from the housing with an appropriate pulling force, with the handle protrusions 16 of the unit 12 being gripped by the user's hands.

However, the typical developing unit is problematic in that it is inconvenient to users while handling the unit in order to remove the unit from the processor's housing when it is necessary to repair or exchange the unit. A user must insert his hands into narrow gaps formed between the opposite ends of the developing unit 12 and the bracket inside the processor's housing and must grip the handle protrusions 16 prior to pulling the unit 12 in order to separate the unit 12 from the bracket.

Figure 3:
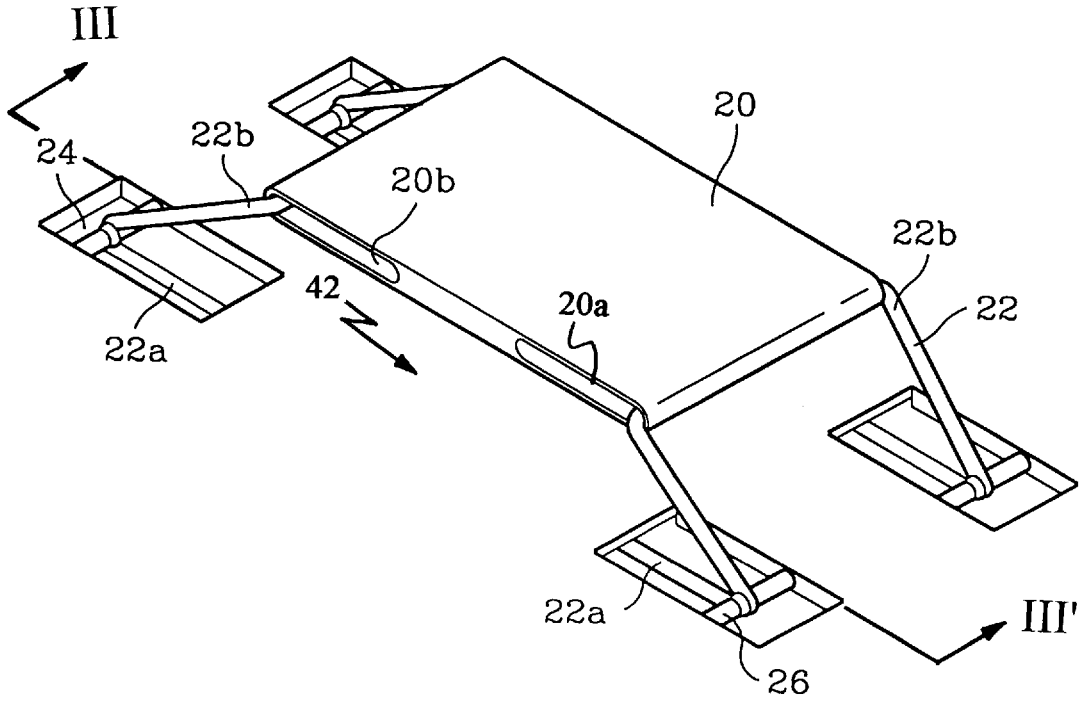
FIG. 3 is a perspective view showing the configuration and construction of a spring-biased handle mounted to the top of a developing unit in the open position in accordance with the preferred embodiment of the present invention.
Figure 4:
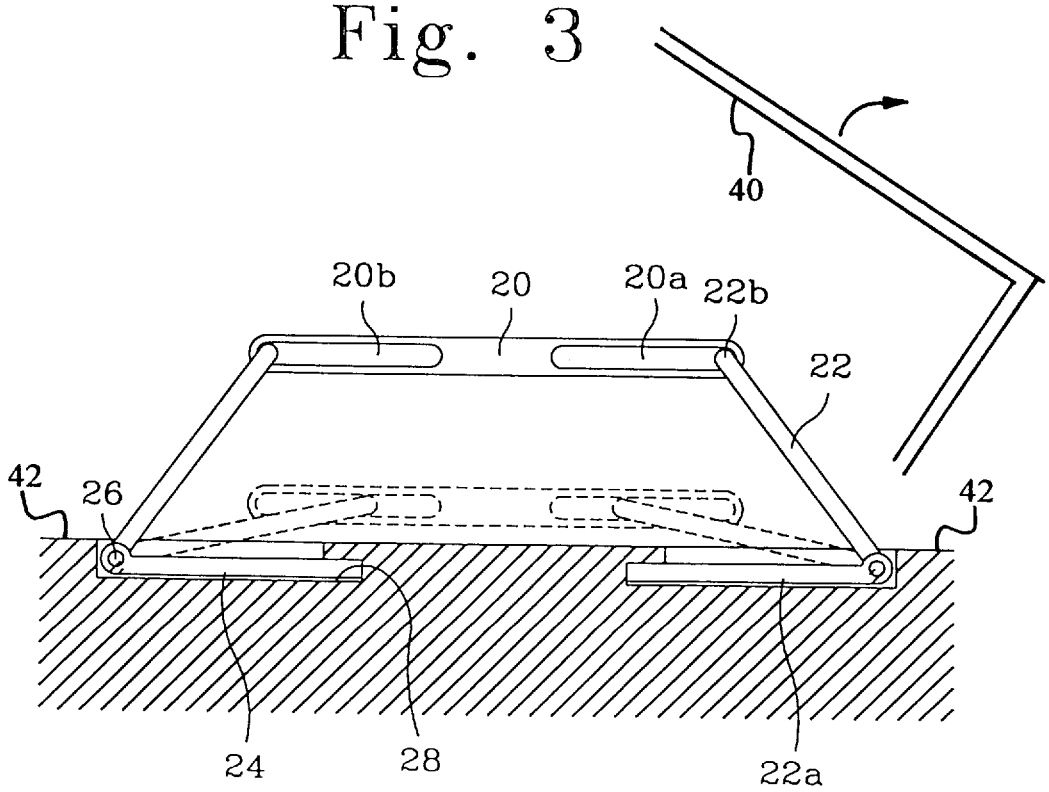
FIG. 4 is a cross sectional view of FIG. 3 taken along III—III' showing the operation of the handle of this invention between a closed position (dashed line) and an open position (solid line).

FIG. 3 is a perspective view showing the configuration and construction of a spring-biased handle mounted to the top of a developing unit in accordance with the preferred embodiment of the present invention. FIG. 4 is a view showing the operation of the handle of this invention.

In the same manner as that described for the prior art, the developing unit 42 is detachably installed in a processor's housing at a position in vicinity to the top of the housing. The top of the processor's housing is covered with an openable top cover 40, so that the top cover 40 must be opened when it is necessary to remove the unit 42 from the housing in order to repair or exchange the unit 42. In accordance with the present invention, a spring-biased handle 20 is provided on the top of a developing unit 42 at a position corresponding to the top cover 40. The handle 20 is connected to the top of the unit 42 by an elastic means 22 which normally biases the handle 20. When the top cover 40 is in its fully-closed position, the cover 40 pushes the handle 20 down against the spring force of the elastic means 22, thus bringing the handle 20 into a closed position. Meanwhile when the cover 40 is opened, the handle 20 is free from the pushing force of the cover 40, so that the elastic means 22 biases the handle 20 upward and thereby brings the handle 20 into an open position where a hand insert opening is formed between the top of the unit 42 and the handle 20.

In the preferred embodiment, two torsion springs are used as the elastic means 22. Both ends of the handle 20 have respective longitudinal slots 20*a* and 20*b*. The coiled torsion springs 22 pass through the respective slots 20*a* and 20*b*, so that springs 22 are coupled to the handle 20. The torsion springs 22 are also coupled to the top of the developing unit 42. In order to couple the springs 22 to the top of the unit 42, four depressions 24 are symmetrically formed on the top of the unit 42 at positions corresponding to the corners of the handle 20. Each depression 24 has a hook recess 28 which is formed on a side wall of each depression 24. The hook recess 28 receives the free end of a spring's coiled arm in order to hold the spring 22 on the top of the unit 42.

That is, the middle portions 22*b* of the torsion springs 22 pass through the respective slots 20*a* and 20*b*, so that the springs 22 are coupled to the handle 20. The free end 22*a* of a spring's coiled arm is caught by the hook recess 28, so that the spring 22 is stably held on the top of the unit 42. The coiled portion of each spring arm is fitted over a shaft 26 which transversely extends in each depression 24. Therefore, the coiled arms of the springs 22 are elastically compressed at the coiled portions around the shafts 26 when the handle 20 is pushed down by the top cover 40.

When the top cover 40 is in its closed position, the spring-biased handle 20 is pushed down by the cover 40, so that the handle 20 is retained in the closed position as shown in the dotted line of FIG. 4. When it is necessary to open the top cover 40, a user lifts up the cover 40 while pushing a top cover release button (not shown) which is provided on the top of the processor's housing. When the top cover 40 is opened as described above, the spring-biased handle 20 is released from pushing force of the cover 40. Therefore, the handle 20 is elastically biased upward by the coiled torsion springs 22, so that the handle 20 is brought into the open position as shown in the solid line of FIG. 4. In the above state, the coiled torsion springs 22 tightly hold both ends of the handle 20. While the handle 20 is elastically raised from the closed position to the open position, the middle portions 22*b* of the springs 22 move from the inside to the outside positions in the respective slots 20*a* and 20*b*.

When the top cover 40 is closed, the top cover 40 pushes the handle 20 down against the spring force of the coiled torsion springs 22 thereby bringing the handle 20 into the closed position as shown in the dotted line of FIG. 4. While the handle 20 is lowered as described above, the middle portions 22*b* of the springs 22 move from the outside to the inside positions in the respective slots 20*a* and 20*b*.

In accordance with another embodiment of this invention, each torsion spring 22 of the handle 20 may be arranged on another position which is rotated from the position described for the preferred embodiment at a right angle. In the above case, the shaft 26 is axially arranged in each depression 24, while the hook recess 28 inside each depression 24 is formed on another position parallel to the axially-extending shaft 26. In a further embodiment, only the coiled torsion springs 22 free from the handle 20 may be installed on the top of the developing unit 42.

The developing units according to the other embodiments yield the same operational effect as that described for the preferred embodiment without affecting the functioning of this invention and further explanation is thus not deemed necessary.

As described above, the present invention provides a structurally-improved developing unit for electrophotographic processors with openable top covers. In the developing unit, a torsion spring-biased handle is mounted to the top of a developing unit in a way such that the handle is elastically raised from its closed position when the top cover is opened. The developing unit is thus convenient to users while handling the unit in order to remove the unit from the processor's housing.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electrophotographic processor, comprising:

a housing for the electrophotographic processor, said housing having a top side, said top side having a cover that opens and closes;

a developing unit detachably installed in said housing near said top of said housing, said developing unit being removable from said housing when the top cover is opened, said developing unit having a top side; and a handle having an elastic means for mounting said handle on said top side of said developing unit and at a position in operational relationship to said top cover, said handle being biased upward by said elastic means, so that the handle is popped up to an open position by the elastic means when the top cover is opened, but said handle is pushed down to a closed position when the top cover is closed onto said handle on said developing unit, wherein a longitudinal slot is formed on each end of said handle, and wherein the longitudinal slot movably couples the elastic means to the handle, each said longitudinal slot containing an outside portion and an inside portion.

2. The electrophotographic processor according to claim 1, wherein a plurality of depressions are symmetrically formed on the top of said developing unit, wherein said plurality of depressions couple said elastic means to the top of said developing unit.

3. The electrophotographic processor according to claim 2, a hook recess is provided in each of said depressions in order to hold said elastic means on the top of said unit, said hook recess being formed on a side wall of each depression in a way such that the recesses in opposite depressions are directed towards each other.

4. The electrophotographic processor of claim 3, wherein said elastic means has an end which moves between said outside portion of each said longitudinal slot and said inside portion of each said longitudinal slot as said handle moves from said open position to said closed position.

5. An electrophotographic processors, comprising:

a housing having a top cover, said top cover rotatable between an open position and a closed position, said top cover having a top side and a bottom side;

a developing unit removably installed in said housing, said developing unit having a top side that becomes exposed when said top cover rotates from said closed position to said open position, said top side of said developing unit becomes unexposed and becomes adjacent to said bottom side of said top cover when said top cover rotates to said closed position;

a set of four depressions formed on said top side of said developing unit;

a handle mounted to the top side of said developing unit, said handle having a pair of longitudinal slots, each said longitudinal slot having an inside portion and an outside portion; and a pair of elastic means, each coupled to two of said set of four depressions and each movably coupled to one of said pair of longitudinal slots, each one of said pair of elastic means coupling said handle to the top side of the developing unit, said elastic means biasing the handle upward so that the handle is popped up to an open position by the elastic means when the cover is rotated to said open position, and said handle is pushed down to a closed position when the cover is rotated to said closed position.

6. The developing unit according to claim 5, said pair of elastic means comprises a pair of springs.

7. The developing unit according to claim 6, said pair of elastic means are a pair of coiled torsion springs.

8. The developing unit according to claim 7, a hook recess being provided in each of said depressions in order to hold each of said elastic means on the top of said developing unit.

9. The electrophotographic processor of claim 8, said torsion springs move between said outside portion of said longitudinal slot and said inside portion of said longitudinal slot as said handle moves from said open position to said closed position.

10. The electrophotographic processor of claim 5, wherein said elastic means each has an end which moves between said outside portion of each said longitudinal slot and said inside portion of each said longitudinal slot as said handle moves from said open position to said closed position.

11. An electrophotographic processor with an openable top cover, said electrophotographic processor containing a developing unit having a spring biased handle that pops up to an open position when said top cover is opened, said spring biased handle is pushed to a closed position when said top cover is closed said spring biased handle comprising:

a handle perforated by a pair of longitudinal slots, each said slot containing an inside portion and an outside portion;

a pair of torsion springs, each spring having a free end and a middle portion, said middle portion being inserted through one of said pair of longitudinal slots; and a shaft about which one of said pair of torsion springs rotates, wherein the longitudinal slot movable couples the elastic means to the handle.

12. The electrophotographic processor of claim 11, said developing unit comprising:

a set of depressions, said shaft located at one end of each of said depressions;

a recess at formed in each depression at an end opposite to said shafts, one end of each of said depressions to secure said free end of said torsion spring.

13. The electrophotographic processor of claim 12, said torsion springs move between said outside portion of each said longitudinal slot and said inside portion of each said longitudinal slot as said handle moves from said open position to said closed position.

14. The electrophotographic processor of claim 11, wherein said torsion springs each has an end which moves between said outside portion of each said longitudinal slot and said inside portion of each said longitudinal slot as said handle moves from said open position to said closed position.

15. An electrophotographic processor, comprising:

a housing for the electrophotographic processor, said housing having a top side, said top side having a cover that opens and closes;

a developing unit detachably installed in said housing near said top of said housing, said developing unit being removable from said housing when the top cover is opened, said developing unit having a top side; and a handle having an elastic means, said handle mounted on said top side of said developing unit by said elastic means and at a position in operational relationship to said top cover, said handle being biased upward by said elastic means, so that the handle is popped up to an open position by the elastic means when the top cover is opened, but said handle is pushed down to a closed position when the top cover is closed onto said handle on said developing unit, wherein a longitudinal slot is formed on each end of said handle, and wherein the longitudinal slot movably couples the elastic means to the handle, each said longitudinal slot containing an outside portion and an inside portion wherein said elastic means has an end which moves between said outside portion of each said longitudinal slot and said inside portion of each said longitudinal slot as said handle moves from said open position to said closed position.

* * * * *